United States Patent [19]

Ohnmacht et al.

[11] 4,321,456

[45] Mar. 23, 1982

[54] ELECTRICAL HOT AIR APPLIANCE

[75] Inventors: Helmut Ohnmacht; Klaus Meywald, both of Kandel, Fed. Rep. of Germany

[73] Assignee: Firma Fritz Eichenauer, Kandel, Fed. Rep. of Germany

[21] Appl. No.: 91,377

[22] Filed: Nov. 5, 1979

[30] Foreign Application Priority Data

Nov. 14, 1978 [DE] Fed. Rep. of Germany ..... 2849316

[51] Int. Cl.[3] ..... H05B 1/02

[52] U.S. Cl. ..... 219/364; 219/370; 219/375; 219/376

[58] Field of Search ..... 219/364, 368, 369–370, 219/374–376, 380–382, 542; 338/296–300, 302, 304, 305, 315, 317, 318, 319

[56] References Cited

U.S. PATENT DOCUMENTS

| | | | |
|---|---|---|---|
| 994,259 | 6/1911 | Kazanjian | 219/374 |
| 1,106,975 | 8/1914 | Schaeffer | 219/375 |
| 1,419,330 | 6/1922 | Van Dyke | 219/542 |
| 3,560,710 | 2/1971 | Fuellemann | 219/364 |
| 3,816,706 | 6/1974 | Meywald | 219/375 |
| 4,034,204 | 7/1977 | Windsor et al. | 219/370 |
| 4,135,080 | 1/1979 | Wells, Jr. | 219/364 |
| 4,195,217 | 3/1980 | Moller et al. | 219/370 |

FOREIGN PATENT DOCUMENTS

| | | | |
|---|---|---|---|
| 1525179 | 9/1978 | United Kingdom | 219/375 |

*Primary Examiner*—B. A. Reynolds
*Assistant Examiner*—Bernard Roskoski
*Attorney, Agent, or Firm*—Craig and Antonelli

[57] ABSTRACT

A heating element for a hair dryer, fan heater or other hot air appliance has heating-conductor support means comprising a length of tube in the interior of which an electronic control arrangement is placed. Where the said arrangement comprises a plate or circuit board this is arranged parallel to the longitudinal axis of the tube. A temperature sensor of the control arrangement is connected directly to the circuit board and projects out of the interior of the tube into the outflowing air flow, preferably from a prolongation of the circuit board which extends beyond the end of the tube. The heating conductor consist of two conductors designed for low power and high power consumption respectively.

9 Claims, 2 Drawing Figures

ELECTRICAL HOT AIR APPLIANCE

Figure 2:
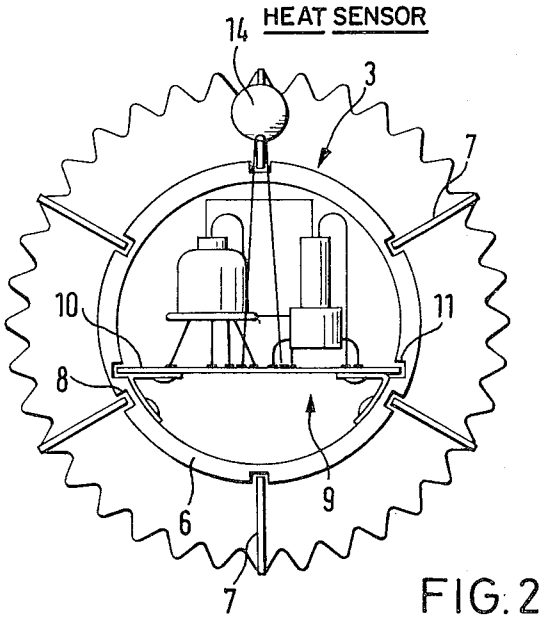

The invention relates to an electrical hot air appliance comprising a blower or fan, a heating element, which comprises a heating conductor support and heating conductor, and an electronic circuit arrangement for the regulation or control of the operation of the hot air appliance.

Hot air appliances of this kind are known in various constructional arrangements as fan heaters, hair dryers and the like. The air to be heated is blown past the heating element by the blower or fan, which is usually driven by an electric motor, and in so doing becomes heated before flowing out through an outlet. The heating conductor support, forming as it were the framework of the heating element, usually comprises a plane or flat plate but in many cases two flat plates fitted together with the use of suitable slots to form a cross-shaped structure as seen in cross-section, and in any case the heating conductor is wound in the form of a coil about the said plates.

In such hot air appliances, use is being made to an increasing degree of electronic circuit arrangements for the regulation or control of the operation of such appliances. Thus, provision is frequently made for infinitely variable regulation of the motor speed by electronic means. More especially in the case of hair dryers it is known to provide the heating element with two heating coils or windings one of which is given a constant and relatively low basic power whereas the current which flows through the other winding, designed for a relatively high power, is so regulated that the temperature of the outflowing air, detected by means of a temperature sensor, decreases after a predetermined period of time. The intention is to treat the at first very wet hair with relatively hot air in a hair drying operation, and, as the hair becomes increasingly drier, to bring down the temperature of the hot air discharged by the hair dryer so as to come down, after a relatively long time, to the temperature which corresponds to the constant basic power.

This kind of pattern of use calls for the employment of an electronic circuit arrangement in the hot air appliance. Normally the electronic circuit arrangement is situated at the greatest possible spacing from the heating element at a suitable region of the housing. As a result of that siting a very large number of manual operations are required in the production of such hot air appliances in order to assemble the individual components, and also special wiring-up measures have to be taken to connect the electronic circuit arrangement to motor, heating element, temperature sensor etc. All this leads to a considerable outlay on labour in the manufacture of known hot air appliances, and is therefore disadvantageous.

The invention has as its object to provide an improved electrical hot air appliance of the category initially specified which can be produced and assembled in a simple and inexpensive way.

According to the invention this object is achieved in that the heating conductor support is constructed as a section or length of tube and the electronic circuit arrangement is arranged within the interior of the tube.

The invention takes as a basic factor the fact that, simply because of the wire length required to obtain the intended heating power, it is not possible to go below a more or less considerable heating element diameter and usually, therefore, the space surrounded by the heating conductor coil is not used. The conventional view is that using this space to accommodate other components of a hot air appliance could not be considered, because of the thermal stressing caused by the heating conductor.

In contrast to that prevailing view, the invention teaches arranging the electronic circuit arrangement in the interior of the heating conductor support, which is provided in the form of a tube. It has been found, surprisingly, that thermal load due to radiation is kept away in a wholly adequate manner by the tube and that also a cooling effect is provided by the fact that non-heated air flows directly, possibly assisted by an induction effect, through the interior of the tube. In any case, an unallowable thermal loading of the circuit arrangement is readily avoided. Thus in the first instance the invention achieves an extremely compact constructional arrangement, but above all the heating element together with the electronic circuit arrangement constitutes a closed unit which can be preassembled in a simple manner and inserted with one manual operation into the hot air appliance, without requiring any complicated wiring-up.

There are various possibilities as regards the construction of the heating conductor support. In a particularly advantageous constructional form there are connected to the tube, peripherally, radially projecting strips or ribs which form supporting edges for the helically wound heating conductor. The ribs can be connected to the tube by means of holding projections formed on to the tube at the end, by means of separate fixing elements (angles, clips and the like) or by axial housing or reception slots formed in the tube.

Using the tube will be made of thermoplastic material of appropriate heat resistant properties, for example by extrusion, while the ribs consist of synthetic mica for example. If the heat resistance of the material allows, the ribs may of course be formed on the tube also, integrally therewith.

If a plurality of heating conductor windings are provided, with different loads, in the manner explained, it is advisable to wind these in the form of coils which surround one another with a radial spacing relatively to one another, and preferably the inner coil is designed for a relatively low, constant, basic power level and the outer coil for a relatively high regulatable additional heating stage. These features regarding the arrangement of heating conductor support and heating conductors are the subject of a U.S. patent application by the Applicants filed at the same time (Ser. No. 091,460, pending, corresponding to German Application No. P 28 49 266.2) the disclosure matter of same being hereby expressly stated as being connected with that of the present patent application.

The electronic circuit arrangement comprises conventionally a substantially plane plate and also conductors and components arranged on the said plate. With such a construction, the invention proposes that the plate is advantageously arranged substantially parallel to the longitudinal axis of the length of tube. This arrangement is advantageous as regards the flowing of non-heated air about the circuit arrangement, and also as regards the fixing of the plate, for which purpose the length of tube preferably has, on its internal wall, holding elements for the plate. These holding elements may comprise for example formed-on straps, but it is particularly advantageous if the holding elements are constructed as reception slots formed in the internal wall of the tube. It is recommended to provide at least two holding slots which advantageously are in alignment with one another along a chord or a diameter of the tube cross-section. These holding slots can be moulded-in in a simple manner when the tubular section is produced, for example by extrusion. The axial securing of the circuit arrangement plate can be effected by cementing, by lateral projections on the plate and/or holding elements, and the like.

In practical work the electronic circuit arrangement is provided above all to regulate or control the temperature of the outflowing air by means of a temperature sensor which is connected to the circuit arrangement. In such a case the invention offers the particularly useful possibility of connecting the temperature sensor directly to the electronic circuit arrangement, in such a manner that said sensor projects out of the interior of the length of tube and into the outflowing air flow. The direct connection with the electronic circuit arrangement means that the temperature sensor is integrated mechanically and electrically with the circuit arrangement, and consequently does not have to be connected thereto by special leads only when the hot air appliance is at the final assembly stage. Thus it is advantageously possible to prefabricate the complete circuit arrangement with temperature sensor, test it if appropriate, and then connect it to the heating element in a simple manner by insertion into the length of tube.

To secure the temperature sensor, suitable rigid connecting parts can be provided on the circuit arrangement plate. It is expecially advantageous to solder the temperature sensor directly into the said plate by means of connecting wires. The connecting wires of conventional temperature sensors are normally so rigid that reliable self-supporting positioning is readily ensured, and precise adjustment to the local situation can be effected by bending the connecting wires.

In every case the arrangement is such that the sensitive element of the temperature sensor is situated in the outflowing heated air flow, and therefore detects the temperature thereof. In some circumstances it is desirable to arrange the temperature sensor at a specific spacing from the heating element so that the heated air has been subjected to some turbulence and homogenisation already by the time it reaches the region of temperature measurement. This can be achieved by providing the circuit arrangement plate with a prolongation at the air outflow side, and arranging the temperature sensor at a spacing from the air outflow end of the tube on this prolongation. The prolongation of course comprises suitable line connections, which are laminated-on for example.

Of course a temperature protection switch is provided in the usual way additionally to the temperature sensor described hereinbefore.

The invention will be explained in detail hereinafter with the help of the accompanying drawings showing just one constructional example.

Figure 1:
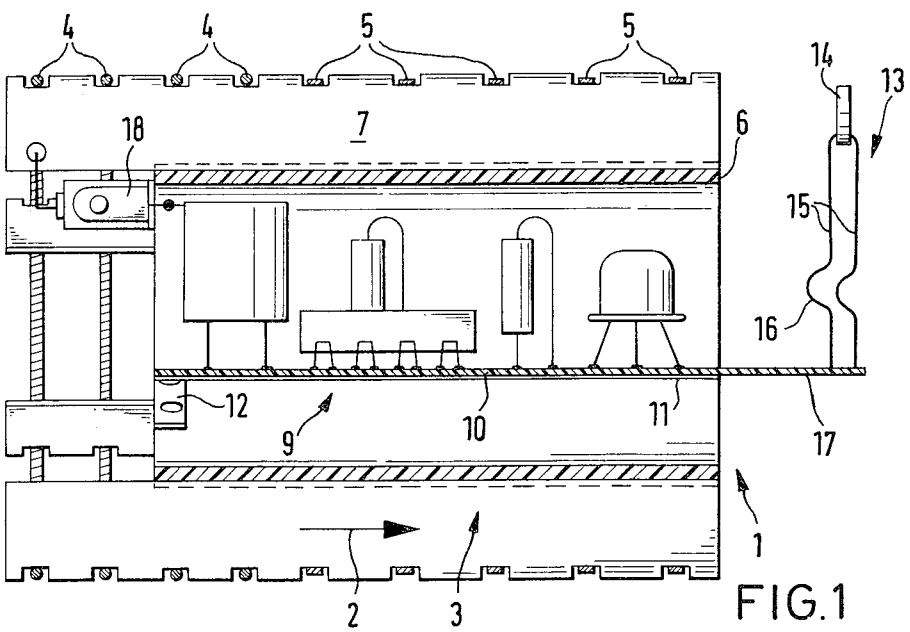

In the drawings:

FIG. 1 shows a heating element with electronic circuit arrangement for a hair dryer, in side view and in section, FIG. 2 shows the subject of FIG. 1 in end view.

The heating element 1 shown in the drawings is intended for a hair dryer. The air flowing through in the direction of the arrow 2 is heated by a relatively low-power constant basic heating system on the one hand and by an intensive additional heating system with regulatable intensity on the other hand. The additional heating is regulated in such a way that the temperature of the outflowing air stream is regulated down from a maximum value, in accordance with a preset time pattern adapted to the rate at which the hair dries, to a value corresponding to the basic heating system.

The illustrated heating element 1 comprises basically a heating conductor support 3 and two heating conductors 4, 5 which are adapted to be controlled independently of one another and of which the heating conductor 4 is designed for a relatively low power consumption and provides basic heating, whereas additional heating is provided by the heating conductor 5 designed for a high power consumption. The heating conductor support 3 comprises substantially a length of tube 6 of thermoplastic material, and ribs 7 which are connected thereto and have a suitable resistance to heat, being made of synthetic mica for example. The ribs 7 in the constructional example are inserted in, and cemented in, reception slots 8 which may be formed-on for example when the tubular section 6 is being produced by extrusion. The two heating conductors 4, 5 are wound coaxially over the ribs 7, one behind the other in the direction of airflow 2. The heating conductors are provided with contacts and are secured at their connecting ends to the heating conductor support 3 in a manner which need not be explained here.

The energisation of the additional heating conductor 5 with electrical energy is regulated by an electronic circuit arrangement 9 which comprises substantially a plane plate 10 with conductors and components which need not be described further here arranged on the said plate, and the said circuit arrangement is arranged in the interior of the tubular section 6. For this purpose the circuit arrangement plate 10 is arranged parallel to the longitudinal axis of the tubular section 6 and held in reception slots 11 which are formed into the inner wall of the tubular section 6 and are in alignment with one another along a chord of the tubular section. The plate 10 is secured against axial shifting by means of holding angle elements 12 connecting it to the tubular section 6.

As explained, in the case of the hair dryer for which the illustrated heating element with electronic circuit arrangement is intended, the temperature of the outflowing air is regulated. To allow this, there is provided a temperature sensor 13 which is connected to the circuit arrangement 9 and whose sensitive element 14-in the illustrated constructional example a resistance with a positive temperature coefficient (PTC element-is situated in the outflowing air stream). The temperature sensor is connected directly to the electronic circuit arrangement 9 in that its connecting wires 15 are soldered directly into the plate 10. The length of the connecting wires 15 is so dimensioned that the sensitive element 14 projects out of the tubular section 6 and into the outflowing air stream. By bending the connecting wires 15, and if appropriate forming corrugations 16, in a suitable manner, the temperature sensor 13 can be adjusted radially and in the peripheral direction of the tubular section 6.

To improve control precision, the temperature sensor is arranged at a spacing from the air outflow end of the tubular section 6 on a prolongation 17 of the plate 10, which of course comprises suitable laminated-on conductors for connection to the circuit arrangement 9.

The heating conductors 4, 5 are connected to the current supply or to the electronic circuit arrangement 9 by way of a temperature protection switch 18.

What is claimed is:

1. A hot air appliance comprising an electrical heating conductor, a blower for forcing air over the heating conductor, an electronic circuit including a temperature sensor for regulating or controlling operation of the appliance, a substantially planar plate with the electronic circuit arranged thereon, and a heat conductor support means including a heat-shielding tubular section, with the electrical heating conductor supported on the outside of the tubular section, said plate located in the interior of said tubular section such that the electronic circuit is shielded by said tubular section from heat generated by the heating conductor, with the temperature sensor projecting exteriorly of the tubular section, into a heated air current flowing along the outside of the tubular section.

2. A hot air appliance according to claim 1, wherein the plate extends essentially parallel to the longitudinal axis of the tubular section.

3. A hot air appliance according to claim 1, wherein said electrical heating conductor comprises two independently operable heating conductors, one being designed for low power consumption and the other for high power consumption relative to each other.

4. A hot air appliance according to claim 2, wherein the tube comprises, at its inside wall, holding elements for the said plate.

5. A hot air appliance according to claim 4, wherein the holding elements comprise reception slots formed in the inside wall of the tube.

6. A hot air appliance according to claim 1, wherein the temperature sensor is soldered into the plate directly by means of connecting wires.

7. A hot air appliance according to claim 1, wherein the plate has a prolongation at the air outflow side, and the temperature sensor is arranged on the prolongation with a spacing from the air outflow end of the tubular section.

8. A hot air appliance according to claim 1, wherein said heating conductor is disposed in surrounding relationship with said tubular support member.

9. A hot air appliance according to claim 1, further including a plurality of rib-like members extending radially outward from said tubular support member, said heating conductor being wound around said tubular support member and supported on the outer edges of said rib-like members.

* * * * *